US007963198B2

(12) United States Patent
Friedenbach

(10) Patent No.: US 7,963,198 B2
(45) Date of Patent: Jun. 21, 2011

(54) TOOL FOR CUTTING USED CONTAINERS OF RECYCLABLE PLASTIC MATERIAL INTO RIBBONS

(75) Inventor: Miguel Friedenbach, Buenos Aires (AR)

(73) Assignee: Miguel Friedenbach, Buenos Aires (AR)

( * ) Notice: Subject to any disclaimer, the term of this patent is extended or adjusted under 35 U.S.C. 154(b) by 1161 days.

(21) Appl. No.: 10/844,991

(22) Filed: May 13, 2004

(65) Prior Publication Data

US 2004/0227022 A1 Nov. 18, 2004

(30) Foreign Application Priority Data

May 13, 2003 (AR) ..... P030101651

(51) Int. Cl.
*B26B 29/00* (2006.01)
*B26B 3/00* (2006.01)

(52) U.S. Cl. ..... 82/47; 83/54; 83/820; 82/70.2

(58) Field of Classification Search ..... 30/280, 30/283, 294; 82/47, 53.1, 101, 70.2; 83/54, 83/425, 820, 440, 444, 448
See application file for complete search history.

(56) References Cited

U.S. PATENT DOCUMENTS

| | | | | | |
|---|---|---|---|---|---|
| 2,575,779 | A | * | 11/1951 | Young | 7/138 |
| 3,791,014 | A | * | 2/1974 | Perna | 30/294 |
| 4,033,531 | A | * | 7/1977 | Levine | 248/558 |
| D255,981 | S | * | 7/1980 | Carbo | D8/98 |
| 4,495,697 | A | * | 1/1985 | Ruff | 30/294 |
| 4,667,409 | A | * | 5/1987 | D'Amato | 30/289 |
| 4,817,907 | A | * | 4/1989 | Cougan | 248/558 |
| 4,979,413 | A | * | 12/1990 | Beller | 83/444 |
| 5,007,171 | A | * | 4/1991 | Horning, Jr. | 30/294 |
| 5,048,188 | A | * | 9/1991 | Wolff | 30/288 |
| 5,072,515 | A | * | 12/1991 | Heitz | 30/304 |
| 5,127,161 | A | * | 7/1992 | Ikeda | 30/294 |
| 5,666,731 | A | * | 9/1997 | Rungren | 30/287 |
| 5,758,423 | A | * | 6/1998 | Eversole et al. | 30/279.2 |
| 5,823,719 | A | * | 10/1998 | Tyler | 407/29.1 |
| 5,865,110 | A | * | 2/1999 | Yonezawa | 99/588 |
| D419,417 | S | * | 1/2000 | Kane | D8/98 |
| D477,520 | S | * | 7/2003 | McCracken | D8/98 |
| 6,745,476 | B2 | * | 6/2004 | Korba, Jr. | 30/292 |
| D525,856 | S | * | 8/2006 | Kwan | D8/325 |
| 2003/0200663 | A1 | * | 10/2003 | Clanton et al. | 30/294 |
| 2009/0320658 | A1 | * | 12/2009 | Yazawa et al. | 83/13 |
| 2010/0236367 | A1 | * | 9/2010 | Aquino Almeida | 83/440 |

FOREIGN PATENT DOCUMENTS

| | | | | |
|---|---|---|---|---|
| EP | 152659 | A1 | * | 8/1985 |
| WO | WO 9102631 | A1 | * | 3/1991 |
| WO | WO 9201527 | A1 | * | 2/1992 |

* cited by examiner

*Primary Examiner* — Boyer D Ashley
*Assistant Examiner* — Sara Addisu
(74) *Attorney, Agent, or Firm* — Defillo & Associates, Inc.; Evelyn A. Defillo

(57) ABSTRACT

A tool for cutting PET bottles and the like into ribbons. The tool includes a toolhead having an opening, a cutting blade housed inside the opening and a slot open above and extending perpendicular to the plane of the blade, downwards through the toolhead a short distance past the blade. The blade has a sharp edge across the slot. The slot receives the edge of the bottle obtained by cutting off the bottle bottom or the funnel and spout thereof. The edge is inserted in the slot and the bottle turned so that the blade cuts through the bottle following a spiral path and producing a ribbon of PET material at an outlet side of the slot.

18 Claims, 12 Drawing Sheets

TOOL FOR CUTTING USED CONTAINERS OF RECYCLABLE PLASTIC MATERIAL INTO RIBBONS

FIELD OF THE INVENTION

The present invention is related to cutting up containers made of plastics or the like, in particular polyethelentereftalate (PET) bottles, into ribbons. PET containers are used and disposed on a large scale and may be industrially recycled. The present invention enables containers to be cut up and immediately used as prime material for a variety of uses. The ribbon thus obtained helps to solve domestic problems, replacing prime materials for use as wires, strings or chords, or industrial problems such as straps for packaging. The ribbon may also be useful for designing and making articles taking into account its technical, dimensional and aesthetic features. The ribbon is useful for manual work usually carried out with threads and may be applied to processes for making baskets, mats and knitting with needles or weaving with a loom. Other processes may be carried out after the cutting process such as heat-forming for erasing the plastic memory of its former shape, giving it new shapes and technical features and broadening its potential as prime material for new uses and articles. The invention helps dispose containers since the volume thereof is drastically reduced when processed according to the present invention.

A large marginal section of the population in big cities makes a living on selling trash found on the streets at very low market prices. We have developed tools within this social-economic context to provide alternative responses to this problem.

The object is to give a suitable technological response that will add value to activities concerning collection and sale of domestic trash and/or to the needs of other socially vulnerable sectors (unemployed, disables, base community undertakings, etc.) by generating economically sustainable microbusinesses.

BRIEF REVIEW OF THE PRIOR ART

Different materials are currently used for making containers of all types. A large part of the containers manufactured for containing products are made using different varieties of plastics. Polyethylenetereftalate is particularly used in view of its advantages over polyene, polyethelene and polypropylene. Polyethylentereftalate, usually known as PET, is a plastic resin that came into use in the last decade. PET containers are characterised by their recyclability. Properties like their impermeability to gas and lack of cementing have made them become widely used for carbonated drink bottles and syphons.

PET then became used for other products, such as oils, mayonaise, cosmetics, etc. Not only did these properties influence the choice of PET by both industry and the consumer. Their lightness compared to the purchased product, about 50 times lighter, and fundamentally their ease of safe handling by users, relative to the risk of breakage, were decisive in generalizing their usage.

From the point of view of the environment, it is the resin that lends itself most to recycling. These containers are identified on the bottom with the number 1 surrounded by three arrows forming a triangle. Recycled PET is not used for new drink or food containers in permanent contact. Other environmental benefits of this resin is the drastic reduction in energy consumed in transportation, the simplicity of processes and the relatively low temperatures required to transform PET into new products, again recyclable.

The post-usage recycling techniques are fundamentally three:

a) Mechanical recycling: This technique is the most used nowadays. The containers are grinded, separated and washed. The flakes resulting from this process may be used, without going back to making pellets, for manufacturing articles by injection or extrusion.

b) Chemical recycling: The basic components of the resin are separated and synthesised into new virgin material. This process broadens the range of materials which may be recycled and leads to substantial savings in gas and hydrocarbons which are prime materials for PET. Different processes for this are: methanolosis, glicolysis and hydrolysis. Another chemical recycling system, which is used in small reactors, is esterification for producing unsaturated resins used for making cold-moulded plastic sheets such as for applications in roofing, mudguard linings, etc.

c) Power generation: Applied in several countries. PET is a polymer formed only by carbon and hydrogen atoms. When PET burns, only carbon dioxide and water ($CO_2$+$H_2O$) are produced and energy released. One gramme of PET releases 22.075 Btu of energy, similar to other oil derivatives.

Although all PET containers may be recycled according to one of the fore-mentioned methods, there are other lesser known methods and uses. PET as well as other plastics may be bundled and used as filler in low parts of rural roads or for adding volume to engineering works.

PET is not biodegradable. Therefore, its widespread consumption and scarce reuse pose serious environmental pollution problems, affecting cleanliness in cities and tourist resorts and blocking urban drainage systems.

Although well developed, the PET industrial recycling technology does not fulfill its environmental purpose because scarcely a small percentage of used PET containers are recycled. Recycling began in Argentina during 1996. In 1997, an equivalent of 18,000,000 units were recycled. Processing was mostly carried out on post-industrial PET and, to a lesser degree, on post-consumption PET coming from "returnable" beverage bottles. The low value of unprocessed containers and the volume requirements associated to transport logistics costs result in that districts with systems for classifying domestic waste and recovery plants, used PET containers are destined to sanitary filling. From the economic point of view, this represents an enormous waste of potentially usable prime material of excellent quality. Another serious problem concerns medium and small communities, geographically apart, wherein prospects of recycling are limited by the volumes available and costs of transport towards centres having the necessary infrastructure available.

One of the most important factors limiting recycling is the lack of simple mechanical methods, which the present invention remedies, for post-consumption recycling for direct reuse of the containers in the same place they are consumed. None of the methods described hereinabove nor the means useful for recycling container plastic material by washing, grinding and compacting or the processes that submit the material to figgerent temperatures, etc. enable the PET to be reused immediately.

Instead of grinding, scissors may be used for cutting PET material up into ribbons to be recycled manually, such as for yarning. Cutting using scissors generates irregular ribbons and is a slow and cumbersome process. Furthermore, scissor leave cut marks on the ribbons where each cutting cycle begins and ends, the cycle depending on the length of the scissor blades. These marks are stress points which weaken the ribbon when tensed, where the ribbon may eventually fail and break. Both for resistence and aesthetic reasons, it is important to prevent the formation of these marks.

A distant antecedent of the tool of the invention is the implement developed by the gauchos (Pampa cowboys) for cutting leather into strips. The gaucho instrument is moved along the leather to cut it into laces which were knitted or intertwined for designing lassoos, whips, reigns and horse mouthepieces.

Systems used heretofore may be generally classified according to the cutting instrument per se into two big groups: simple and articulated. The simple tools carry out there purpose by the sharp edge applying a lateral force. If only one side has the sharp edge, the material is be cut in one direction only or, if both edges are sharp, the material is cut in divergent directions. Although formed with multiple parts (grip-blade-handle-rod) which are clearly distinct, it can be said that they are practically integrated. On the other hand, articulated tools operate by the combined effort of their (moving) blades which pivot about the shaft holding them together and which causes them to converge on the object being cut up. In comparison with the static and integrated structure of the former, simple tools, the articulated tools are characterised by the mobility of their blades by pressing in opposite directions. Examples of simple tools are the knife and the axe; of articulated tools: pliers and scissors.

SUMMARY OF THE INVENTION

A tool for reprocessing containers, or other hollow objects having a wall thickness, of a cuttable material. The tool is particularly useful for cutting PET in view of the strength of this material. The containers are cut into ribbons of selected heights and widths in an orderly manner. The invention further includes a process for cutting such containers by means of the use of the tool.

A novel feature of the tool and instrument of the invention is that the cutting action is not the result of the blade movement but rather the blade slitting through the object being cut, such that the contact points progressively approaching produce the same effect as in the articulated tools but with less effort. The tool enjoys features of both the simple and the articulated groups but, at the same time, it is different in that the material being processed is moved against the blade, the latter being held stationary, unlike scissors.

The tool of the present invention enables the plastics to be reused immediately by orderly cutting the PET material up into ribbons of selectable width and thickness (constant dimensions), This method is simpler and more economical than any known industrial cutting or grinding process. The ribbons resulting from this method are suitable for manual work, such as in yarning, wherein this type of ribbon is heretofore obtained using scissors as mentioned hereinbefore.

The tool of the present invention may impact the quality of life of the entire population and, in particular, of small and middle-sized communities where these types of containers pose a serious environmental problem.

BRIEF DESCRIPTION OF THE DRAWINGS

Ways of putting this and other subject-matter and advantages of this disclosure into practice will become more clearly apparent by reference to the following detailed description and to the attached drawings of the preferred embodiments of this disclosure, which are merely examples and in no way a limitation, wherein.

In the above tool drawing FIGS. 1 to 48, the PET material, e.g. container and ribbon, is illustrated in phantom to make it distinct from the tool for viewing.

PREFERRED EMBODIMENTS OF THE INVENTION

Figure 1:
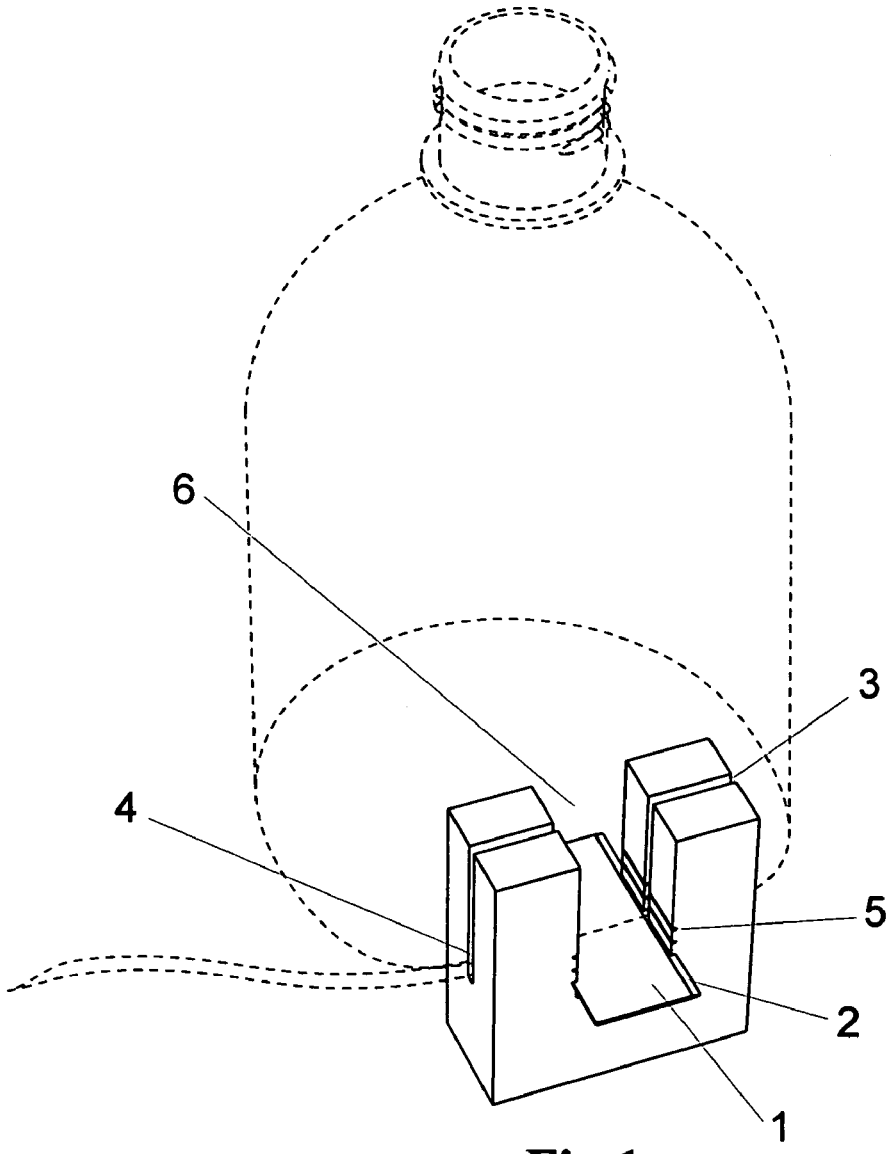
FIG. 1: A perspective view of a tool having a "U"-shaped toolhead or main body and tool components according to an embodiment of the invention.
Figure 2:
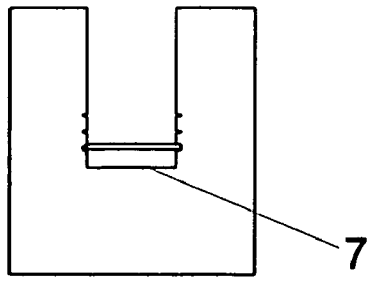
FIG. 2: A side elevation view of the toolhead shown in FIG. 1.
Figure 3:
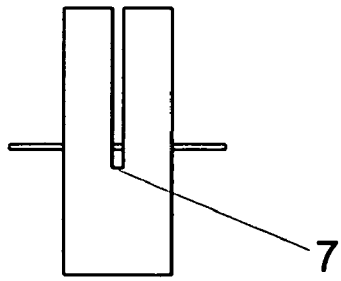
FIG. 3: A front elevation view of the toolhead shown in FIG. 1.

The Tool:

As illustrated in FIGS. 1 to 3, the tool comprises a "U"-shaped main body or toolhead shaped with an opening 6 inside the "U" for housing cutting means such as a blade 1, cutter, shaving blade or other suitable means. The cutting blade 1 is plane, fixed and defines, as the cutting processes begins, the upper edge of the ribbon product. The cutting blade 1 is arranged perpendicular to a slot 3-4 divided into two sections by the opening 6. The blade 1 has a sharp edge 2 towards the slot section 3 on the side where the PET material is inputted; the other slot section 4 is the PET ribbon output side.

Figure 5:
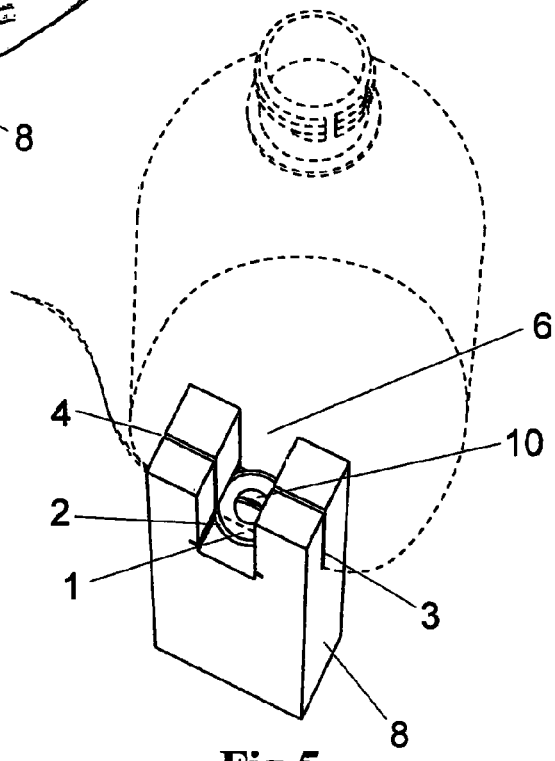
FIG. 5: A perspective view of a tool embodying a circular cutting blade.
Figure 6:
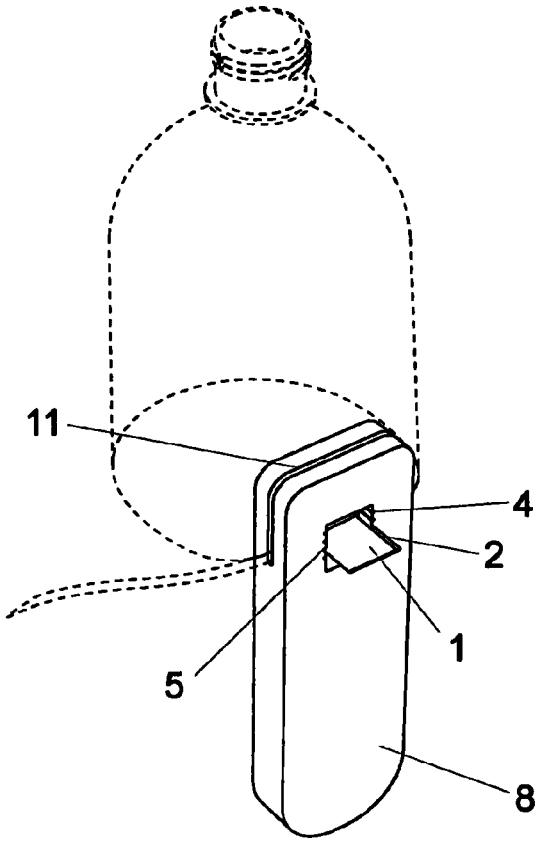
FIG. 6: A perspective view of a tool embodying a closed opening.
Figure 7:
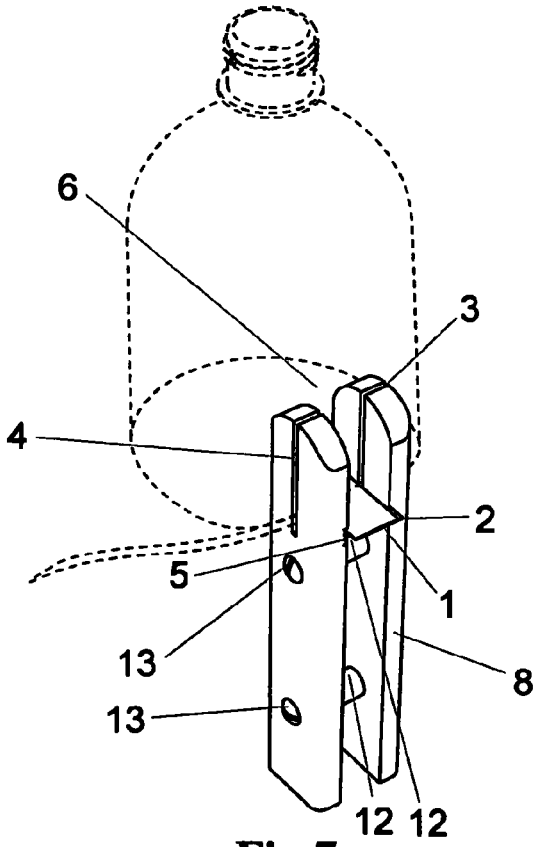
FIG. 7: A perspective view of a tool embodying two members joined together.

Another embodiment takes into consideration the wear of the blade 1. FIG. 5 shows a reversible or circular blade 1 to reduce blade wear. The circular blade 1 is secured to the toolhead by a screw 10. The screw 10 may be loosened to rotate the blade after some use to change the sharp edge.

Figure 4:
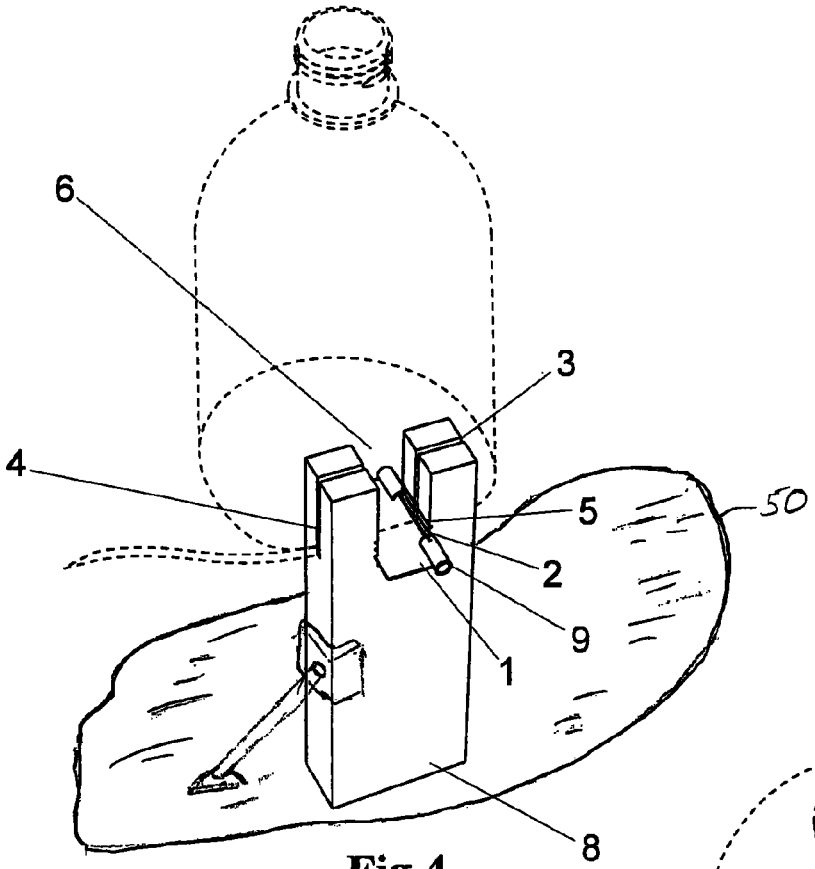
FIG. 4: A perspective view of a tool embodied with a toolhead, handle or grip and means protecting the cutting blade.

The toolhead is made of any suitable material such as wood, plastics, metal or combination thereof. The toolhead may be integrated to a grip or handle 8 forming a single piece, as illustrated in FIG. 5, or otherwise attached thereto. In either case, the tool is adapted for holding by the user. Referring to FIG. 4, the toolhead may otherwise be affixed to a workbench or installed in a machine tool, either of which being designated by reference 50 in FIG.4.

The slot 3-4 or 11 is at the top of the toolhead and is a housing of the tool for the container to be cut. The width of the slot is dimensioned so that the object to be cut may penetrate down to the bottom thereof whereas the length of the slot should be sufficient to stabilize the container during the cutting process. The depth of the slot influences the bottle stability during the cutting process, the deeper the slot the stabler the container. The bottom 7 of the slot defines the lower edge of the resulting ribbon.

Figure 20:
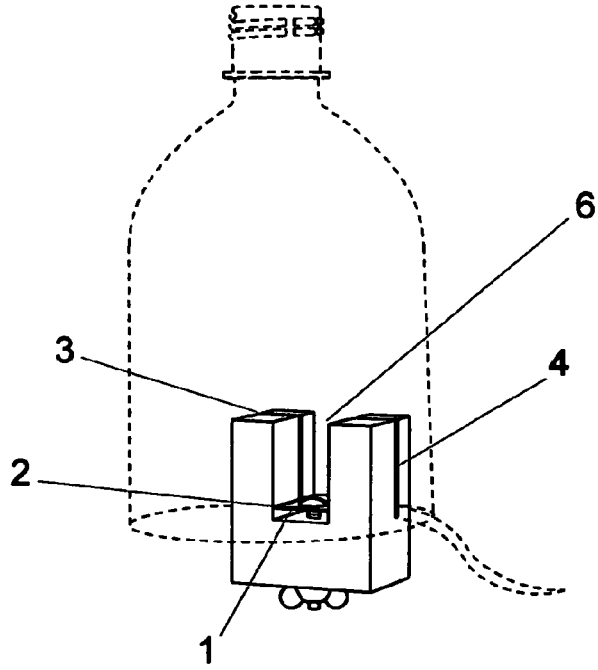
FIG. 20: A perspective view of a "U"-shaped toolhead further embodying a shiftable cutting blade.

The slot bottom may be varied in order to regulate the ribbon width, basically in one of four ways:

a) Several grooves 5 in the opening side where the blade 1 lodges so as to be able to place the latter at selectable distances from the fixed slot bottom 7. The height of the ribbon may be cut by placing the blade 1 in a different groove.

b) Plural slots 11 of different depths as illustrated in FIGS. 9 to 11 and 15 to 18. In this case, ribbon height is dependent on which slot 11 engages the PET bottle edge.

c) A movable member functioning as an adjustable stop 18 as illustrated in FIGS. 12, 13 14 and 19, thereby shifting the bottom of the slot to vary ribbon height. The adjustable stop 18 may comprise a metallic member movable along a guide 20 and retained in a desired position by tightening a screw 19. The adjustable stop member 18 may be moved during the cutting process, to produce a ribbon of varying width.

d) A movable cutter blade is mounted to a member moving it on the toolhead as illustrated in FIG. 20 by means of an adjustable screw.

The tool may be manufactured in one of several ways to serve its purpose. Typically, a "U"-shaped opening 6 may be cut out in a wooden block to make the toolhead, as illustrated in FIG. 4. The cutter blade is inserted in the "U"-shaped opening. A slot 11 is cut in the wooden block, across the "U"-shaped opening 6 and perpendicular to the plane of the blade 1. The slot 11 should be wide enough to fit the PET container or bottle thickness therein.

Figure 8:
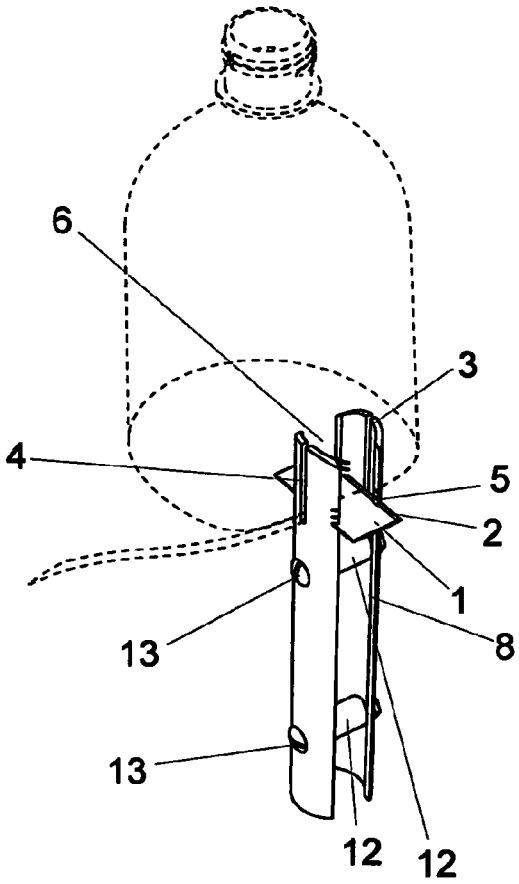
FIG. 8: A perspective view of a tool embodying two "half-circle" shaped sections joined together by joining means.

An alternative manufacturing embodiment is to use two wooden blocks (FIG. 7), a cylinder length or a tube cut longitudinally to provide two members having a half-circle cross-section (FIG. 8). Either way, the pair of members are joined by means of other joining members 12, generally two, securing the two members by means of screws 13. Room 6 is left in the top part where the two members are joined to form the spacing 6 in the "U" of the typical embodiment of the tool of the invention, where the blade 1 is located. The slot or slots 11 are cut from above down through the legs of the "U" perpendicular to the blade 1 wide enough for the container edge to fit. As described hereinafter in relation to FIG. 21 onwards, the container edge is the generally circular edge resulting from cutting off the bottle neck and spout.

Figure 9:
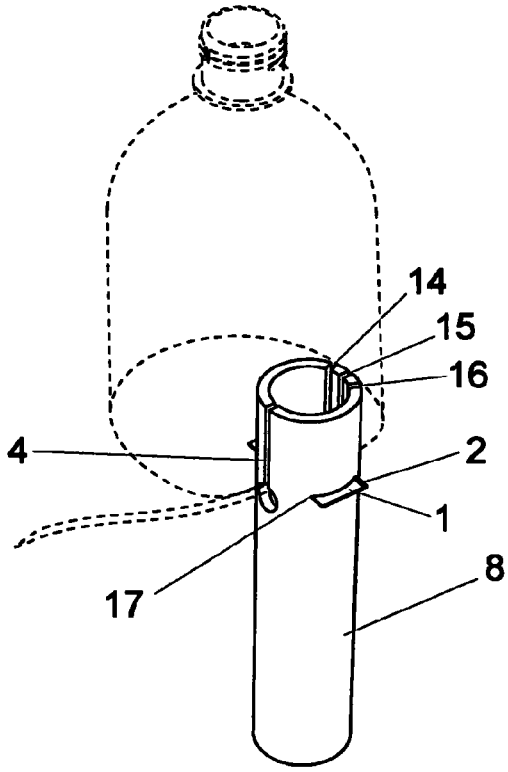
FIG. 9: A perspective view, from the ribbon output side, of a tool embodying a cylindrical shape and including slots of different depths and a minimum orifice for holding the cutting blade.
Figure 10:
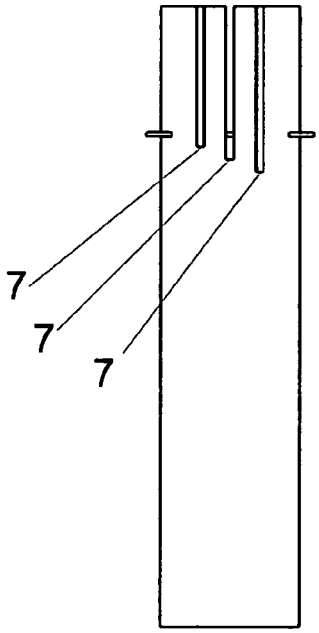
FIG. 10: A front elevation view of the cylindrical tool of FIG. 9.
Figure 11:
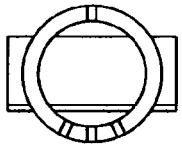
FIG. 11: A top plan view of the cylindrical tool of FIG. 9.
Figure 12:
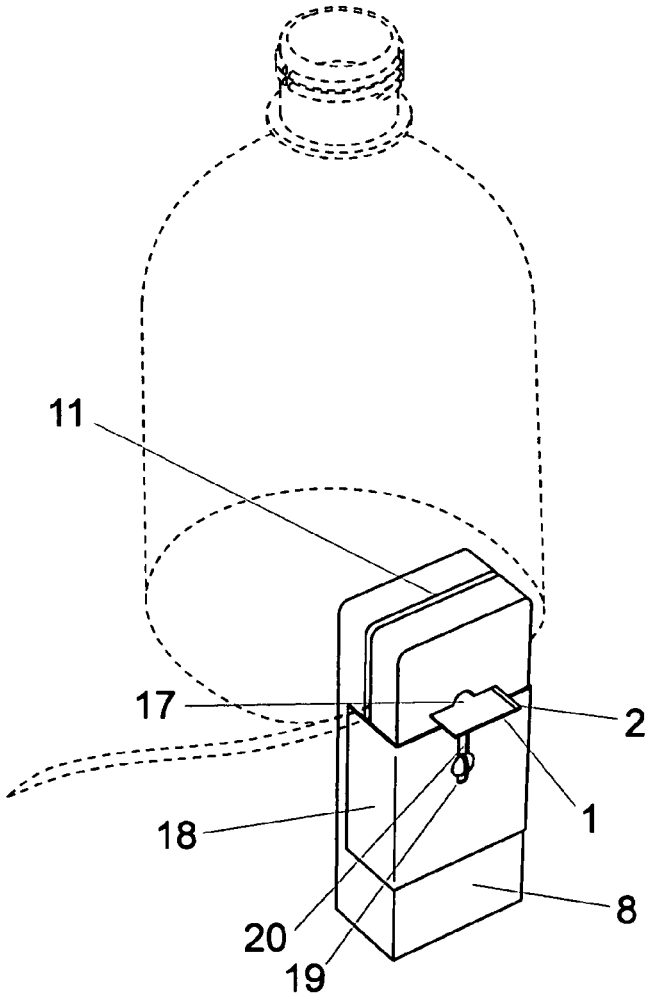
FIG. 12: A perspective view of a tool embodying a movable stop.
Figure 13:
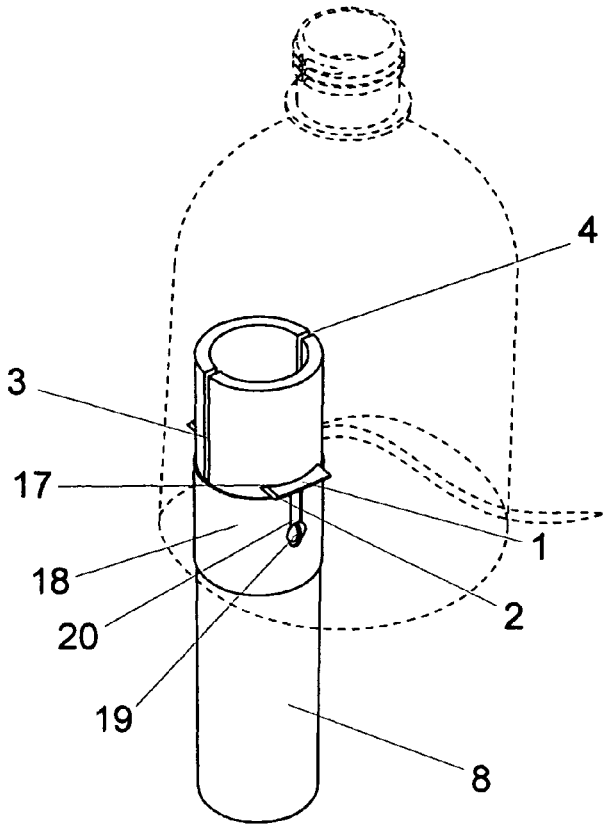
FIG. 13: A perspective view, from the ribbon output side, of a cylindrical tool embodying a moveable stop.
Figure 14:
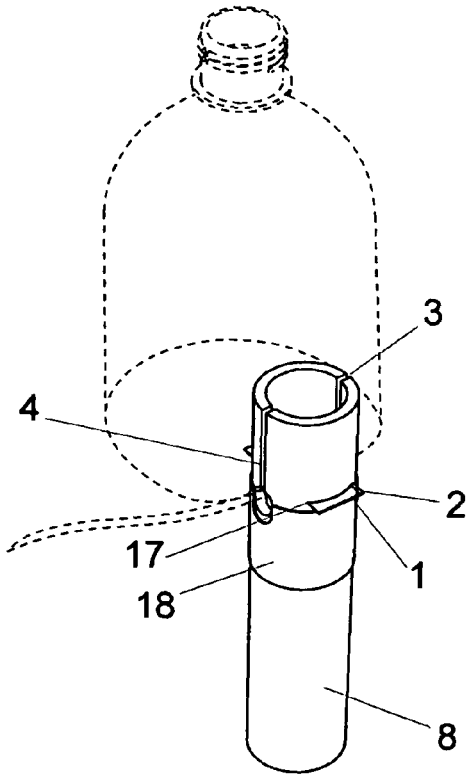
FIG. 14: A perspective view, from the ribbon input side, of the cylindrical tool having the moveable stop according to FIG. 13.

As illustrated in FIGS. 9 to 11, another manufacturing embodiment, among others, takes a cylinder or tube of hard metal or plastic material and makes an orifice or opening 17 therein for inserting the cutting blade 1. Several slots are cut from the top down to different depths, e.g. a deep slot 14, a medium slot 15 and a shallower slot 16. The top part of the cylinder or tube is the toolhead and the lower part may be used as the grip or handle. In this embodiment, the opening is not "U"-shaped but barely big enough for the blade 1 to fit therein. There are no notches for changing the blade position, the slot depths determine the width of the cut ribbon.

Figure 15:
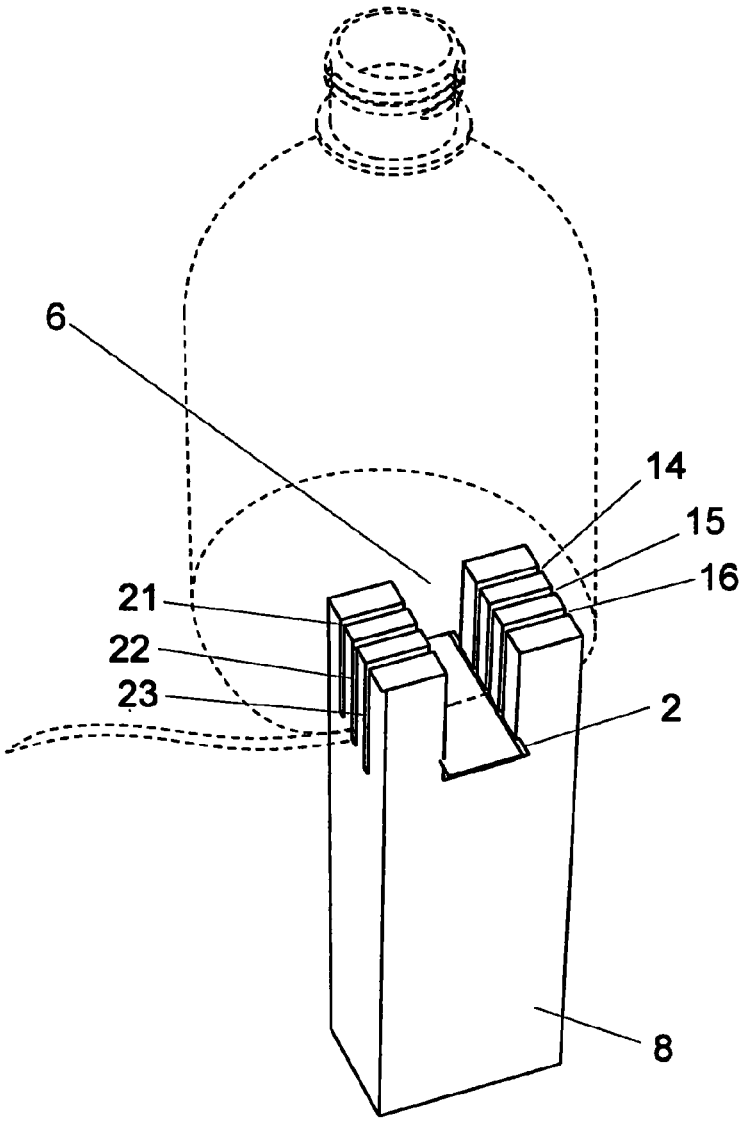
FIG. 15: A perspective view of a tool in an integrated single-piece embodiment, including a toolhead and a handle or grip, the toolhead provided with slots of different depths for graduating the ribbon height.
Figure 16:
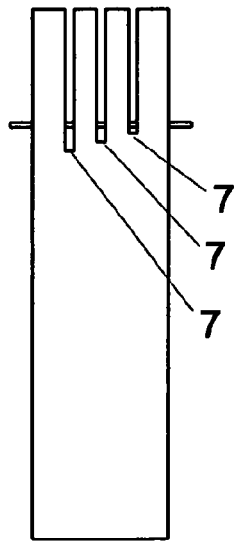
FIG. 16: A front elevation view of the tool of FIG. 15.

A preferred embodiment of the tool includes several slots 21-23 for adjusting the lower cutting level at the ribbon output side, e.g. a lower level 21, a medium level 22 and a higher level 23, in combination with the different depth of the slots 14, 15 and 16 at the ribbon input side, as shown in FIG. 15.

All the embodiments provide a tool which is safe to use. However, additional means may prevent accidents and risks of a user getting cut. User protection means may include "U"-shaped cylindrical profiles 9 or like means hooding the portion of the cutter blade projecting from the tool, as illustrated in FIG. 4. The protection means may be made of any suitable material and also be a functional part of the tool as described hereinafter.

Figure 17:
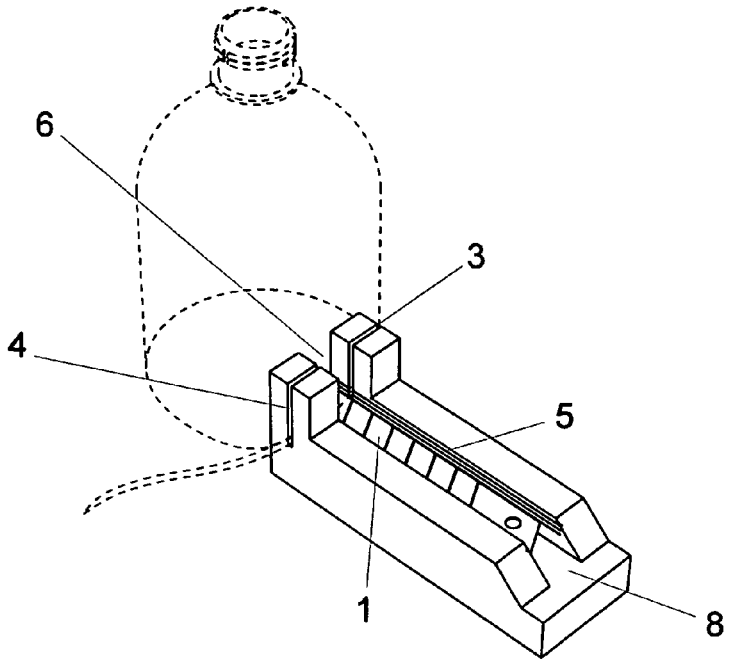
FIG. 17: A perspective view of a tool embodying a handle perpendicular to the toolhead for user-safely holding the cutter blade.
Figure 18:
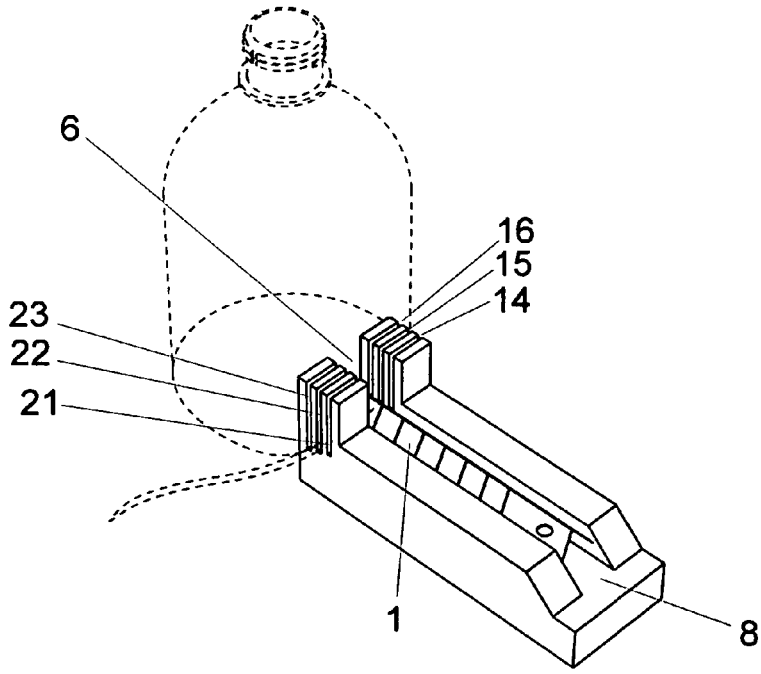
FIG. 18: A perspective view of a tool embodying a handle perpendicular to the toolhead for user-safely holding the cutter blade and with slots of different depths.
Figure 19:
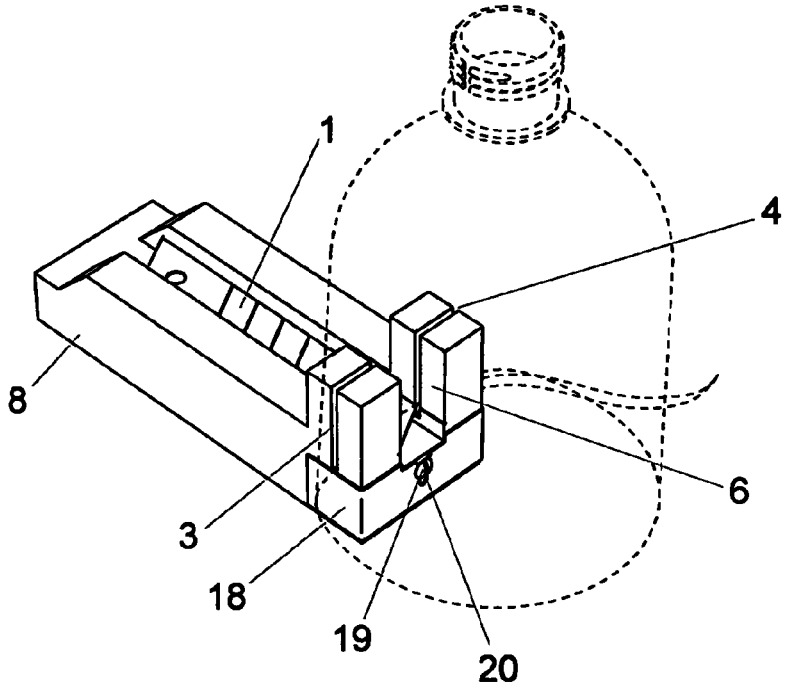
FIG. 19: A perspective view of a tool embodying a handle perpendicular to the toolhead for user-safely holding the cutter blade and provided with a movable stop.

The grip or handle may otherwise be arranged perpendicular to the toolhead such that the blade and its cutting edge are protected from the grip and out of risk to the user, as illustrated in FIGS. 17, 18 and 19.

The Process:

PET containers formally comprise a cylindrical main body, a conical funnel or neck connecting a spout to the main body and a base or bottom closing off the other end. The main body is a cylindrical surface of a constant or variable generatrix according to the bottle design. A flat ribbon may be obtained from this part of a right-cylindrical container having a straight generatrix or an otherwise specially-shaped ribbon when the container has a different shape.

During the cutting process, the tool travels through the cylinder main body following a spiral path of like diameter and axis. The length of the ribbon depends on the number of turns traveled by the cutting tool which, in turn, depends on the height of the cylindrical main portion of the container and the set width of the ribbon.

Figure 21:
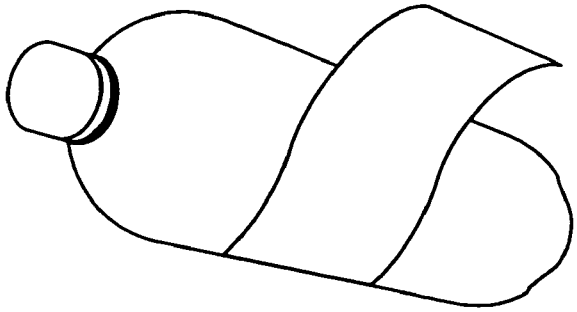
FIG. 21: A perspective view of a carbonated beverage bottle showing removal of the label therefrom as the first step towards a process for cutting it into a ribbon according to the present invention.

The following example describes the cutting process for a beverage PET bottle. First, the label is removed (FIG. 21).

Figure 22:
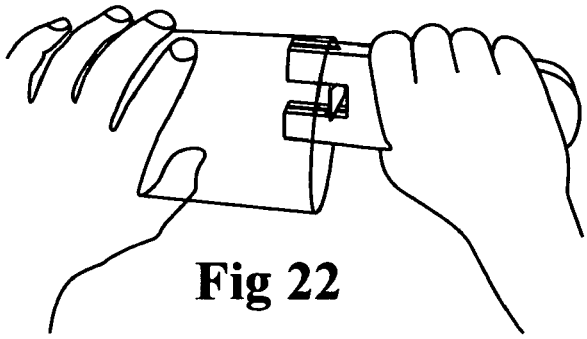
FIG. 22: A perspective view of the bottle of FIG. 21 engaging the tool.

Then, the funnel with the spout is sectioned off from the main cylindrical surface, leaving the user with a container cylinder body for processing, with a straight or flat edge at one end ready for cutting and the bottle bottom at the other (FIG. 22). The cylindrical body is then inserted via said edge into the tool slot until it abuts against the cutting blade, whereafter the tool is ready for the cutting process to begin (FIG. 22).

Figure 23:
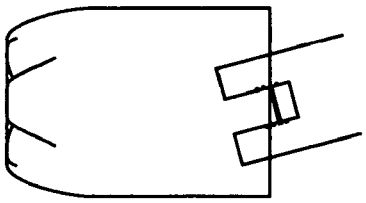
FIG. 23: A magnified detailed view showing the tilt angle between the bottle axis and the cutting plane.
Figure 24:
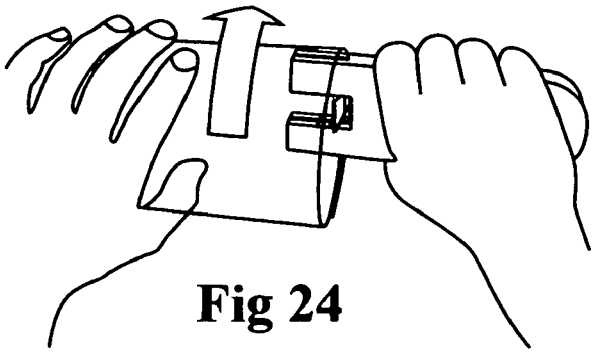
FIG. 24: A perspective view of the bottle as the tool begins to cut it into a ribbon.

Cutting begins by first tilting the cylinder axis relative to the blade plane, so that only the sharp edge thereof contacts the edge of the open container cylinder at an angle suitable for penetration (FIG. 23). Thereafter, the cylinder is made to turn about its axis so that its material passes through the slot of the tool and is interested by the cutting blade 1 (FIG. 24). A ribbon soon issues, having a width which initially increases until it reaches the distance between the blade and the lower edge of the slot. The tool thus reaches the point of stabilization, after which the ribbon is cut with a constant width.

It is also possible to first cut the cylinder with a knife or scissors and then thread the cut ribbon end into the tool slot.

Soon after cutting begins, the ribbon end comes out through the output side of the tool slot. Thereafter, the user may continue the process by pulling the ribbon through the slot (FIG. 25), as long as the resistence of the material to traction stress is greater than the force required to move and cut the cylinder.

Figure 25:
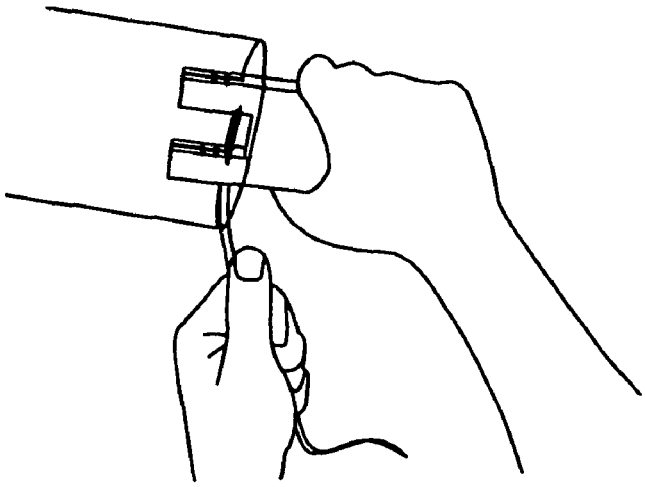
FIG. 25: A perspective view of the bottle in the midst of the cutting process and of the resulting spiral-shaped ribbon.
Figure 26:
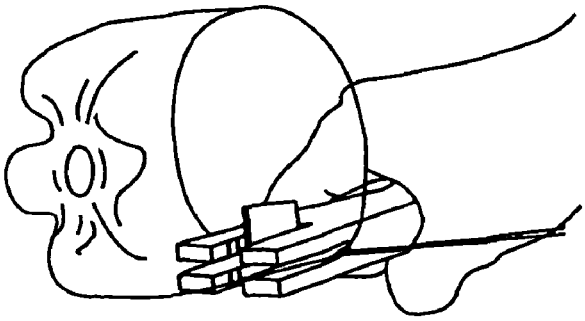
FIG. 26: A perspective view of the bottle and the tool in an end-phase of the cutting process.

As illustrated in FIG. 25, the tool may be held in one hand and the ribbon pulled with the other, the cylinder turns without direct action on the part of the user, dragged by the traction exerted by the ribbon, generating an orderly cut which the user may carry out with ease and constant speed and dimensions.

The ribbon is pulled until the tool reaches the end of the spiral cutting path through the main body of the container, continuing thereafter on the container bottom (FIG. 26) until the tool lets go of the bottom which generally may not be processed jointly because of the resistence produced by its sudden change of shape against the slot of the tool.

The Ribbon:

The recyclable material obtained from this process is a spiraling flat ribbon. The material and colour of the ribbon is that of the bottle or container material. The ribbons produced by the process just described hereinabove may be immediately used for recycling the plastic material.

The cylinder body between the container bottom and the funnel converging towards the spout is deemed the useful part of the container which may be processed, since it provides the more even and flatter ribbon. If the main body of the container is not cylindrical, an even and flat ribbon may generally still be obtained except for imperfections resulting from the particular shape of the container body which will be evident in the resulting ribbon.

Figure 27:
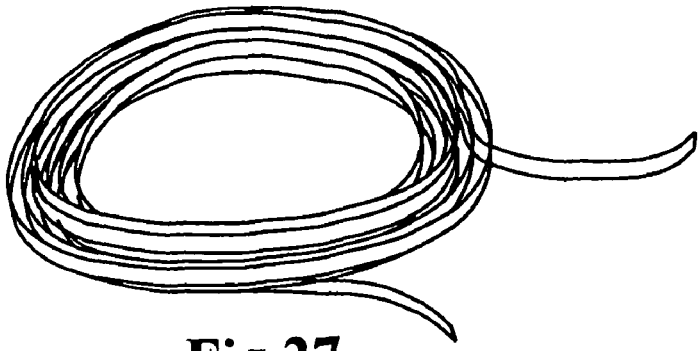
FIG. 27: A perspective view of the ribbon produced by the tool slitting the bottle up.
Figure 21:
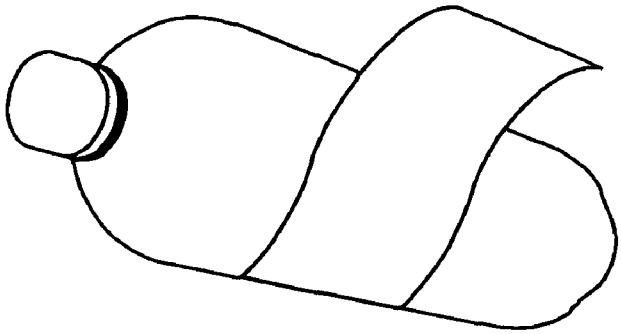
Figure 28:
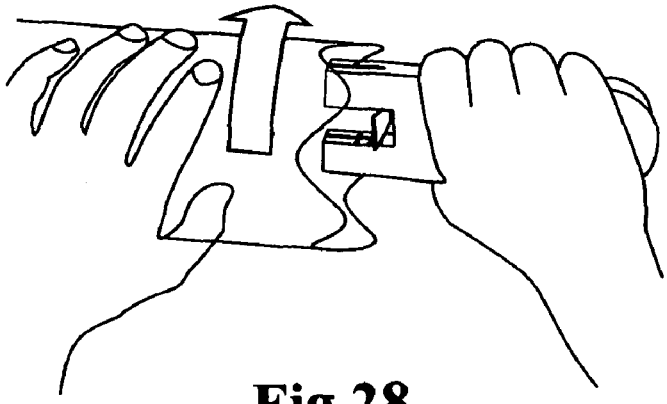
FIG. 28: A perspective view similar to FIG. 24 showing a bottle alternatively precut with a zig-zag-shaped useful edge.
Figure 29:
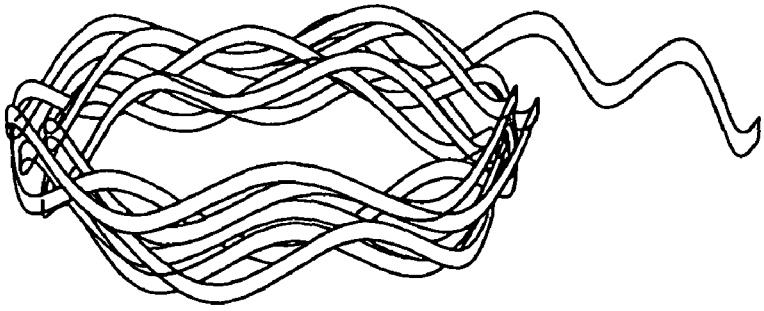
FIG. 29: A perspective view of the ribbon form resulting from the tool slitting through the irregularly-precut bottle prepared as illustrated in FIG. 28.

FIGS. 27 and 29 show different forms of the recyclable ribbon product obtained according to how the used container is prepared for processing as illustrated in FIGS. 24 and 28. The thickness of the ribbon is the wall thickness of the PET bottle before processing, i.e. the distance between the inner and outer cylinder surfaces thereof. The width of the ribbon, i.e. the distance between the cut edges thereof, is determined by the distance between the sharp blade edge and the bottom of the tool slot. The ribbon width may be adjusted in the tool but not the ribbon thickness, which is the thickness of the container sidewall.

The length of the ribbon, i.e. the distance from end to end, is determined by the surface area of the container cylinder and the width set by the tool. The area of a main elongated face of the ribbon is the same as the surface area of the container cylinder such that the length of the ribbon is inversely proportional to the ribbon width set by the tool.

Of course, changes, variations and aggregations may be made to the multiple embodiment describe above, without departing from the scope nor the spirit of the invention. The same has been described by way of preferred embodiments specifically for PET bottles, however those skilled in the art may suit it to other applications without departing from the purview of the invention as set forth in the appended claims. For instance, the base or bottom of the container may be cut off initially instead of the funnel, such that the cutting process continues through the funnel after cutting the main cylinder body up into the ribbon.

I claim:

1. A tool for cutting a hollow object into a ribbon of predetermined width and length, said hollow object having a flexible wall made of a cuttable material having a thickness, said tool comprising:

a toolhead having a main body, the main body having an opening, the opening defining a first wall, a second wall, an open top end, and a bottom wall, wherein the flexible wall of the hollow object enters the tool through the first wall and exits the tool through the second wall;

cutting means housed parallel to the bottom wall of said opening, wherein the cutting means is flat and has a sharp edge facing the first wall in the direction that the flexible wall of the hollow object enters the tool, at least one slot running through the main body, wherein the opening cuts the at least one slot in two sections, wherein one section passes through the first wall and the other section passes through the second wall of the main body;

wherein the cutting means is placed perpendicular to the at least one slot;

wherein the at least one slot is perpendicular to the opening;

wherein said tool cuts the flexible wall into a spiral shape forming the ribbon when said flexible wall is turned relative to said first wall and in direction towards said sharp edge, thereby cutting the ribbon.

2. The tool of claim 1, wherein said at least one slot includes a bottom end and wherein the tool further comprises sliding means to mount the cutting means on said toolhead, wherein the sliding means varies the distance between said cutting means and the slot end, enabling the ribbon to be adjusted to a preselected width.

3. The tool of claim 1, further comprising a plurality of said slots, each slot having a bottom end at a different distance from said cutting means such that the ribbon is cut by said tool to a width preselected by the slot in which the object wall is inserted and turns.

4. The tool of claim 1, wherein said cutting means is a blade having at least one sharp edge.

5. The tool of claim 1, wherein said cutting means is a cutter.

6. The tool of claim 1, wherein said cutting means is hooded for protecting the user from accidental cutting.

7. The tool of claim 1, including a grip or handle integrated in one piece to said tool.

8. The tool of claim 1, wherein said tool is secured to a workbench.

9. The tool of claim 1, wherein said tool is installed in a machine tool.

10. The tool of claim 1, wherein said hollow object is a container or a bottle.

11. The tool of claim 1, wherein said cuttable material is PET.

12. A process for cutting a hollow object into a ribbon of predetermined width and length, said hollow object having a wall, said wall made of a cuttable material having a thickness, said process including the steps of:

a) providing a cutting tool comprising:

a toolhead having a main body, the body having an opening, the opening dividing the main body into a first wall, a second wall, an open top end, and a bottom wall;

cutting means housed near the bottom wall of said bottom wall, the cutting means having a sharp edge;

at least one slot located in the main body, wherein the opening cuts the at least one slot in two sections, wherein one section passes through the first wall and the other section passes through the second wall of the main body;

wherein the cutting means is placed perpendicular to the at least one slot;

wherein the sharp edge of the cutting means is placed extending transversely and towards the slot of the first wall;

b) providing an open end in said hollow object;

c) inserting a portion of said open end in the slot of said first wall of the toolhead until it contacts said cutting means;

d) tilting the hollow object or the toolhead until both form an angle with one another; and e) turning said hollow object relative to said toolhead causing said cutting means to cut a ribbon of a substantially constant width between said cutting means and bottom end of the slot.

13. The process of claim 12, wherein said hollow object is a bottle including a main body having a top end and a bottom end, a bottom closing off the bottom end of said main body, a spout and a funnel connecting the spout to the top end of said main body, said step of providing an open end in said container comprising cutting off said spout and said funnel whereby that said top end becomes said container edge engaging said tool slot.

14. The process of claim 12, wherein said step of providing an open end in said hollow object comprises cutting said hollow object to form a straight edge.

15. The process of claim 12, wherein said step of providing an open end in said hollow object comprises cutting said hollow object to form an edge having an irregular shape.

16. The process of claim 12, wherein the length and width of said ribbon is selected by adjusting the distance between said cutting means and said slot bottom end.

17. The process of claim 12, wherein said step e) comprises pulling said ribbon through said toolhead slot.

18. A ribbon useful for recycling, the ribbon obtained from a plastic hollow object by use of the tool for cutting the hollow object into the ribbon of predetermined width and length, said object having a flexible wall and made of a cuttable material having a thickness, said tool comprising:

a toolhead having a main body, the body having an opening, the opening defining a first wall, a second wall, an open top end, and a bottom wall, wherein the flexible wall of the hollow object enters the toll through the first wall and exits the tool through the second wall;

cutting means housed parallel to the bottom wall of said opening bottom, wherein the cutting means is flat and has a sharp edge facing the first wall in the direction that the flexible wall of the hollow object enters the tool, at least one slot running through the main body, wherein the opening cuts the at least one slot in two sections, wherein one section passes through the first wall and the other section passes through the second wall of the main body;

wherein the cutting means is placed perpendicular to the at least one slot;

wherein the at least one slot is perpendicular to the opening;

wherein said flexible wall is cut into a spiral shape forming the ribbon when said wall is turned relative to said first wall and in direction towards said sharp edge, thereby cutting the ribbon.

* * * * *